US005186447A

United States Patent [19]

Knecht

[11] Patent Number: 5,186,447

[45] Date of Patent: Feb. 16, 1993

[54] APPARATUS FOR THE AUTOMATIC FILLING OF A MAGAZINE

[75] Inventor: Siegfried Knecht, Gevelsberg, Fed. Rep. of Germany

[73] Assignee: Maschinenfabrik Alfred Schmermund GmbH & Co., Gevelsberg, Fed. Rep. of Germany

[21] Appl. No.: 580,781

[22] Filed: Sep. 11, 1990

[30] Foreign Application Priority Data

Sep. 12, 1989 [DE] Fed. Rep. of Germany ..... 3930369

[51] Int. Cl.[5] ..... B65H 1/26

[52] U.S. Cl. ..... 271/3.1; 271/157; 271/189; 271/218; 414/798.1

[58] Field of Search ..... 271/3.1, 157, 158, 159, 271/189, 218; 414/798.1

[56] References Cited

U.S. PATENT DOCUMENTS

| | | | |
|---|---|---|---|
| 1,792,878 | 2/1931 | Wagner . | |
| 3,027,021 | 3/1962 | Kramer . | |
| 3,776,544 | 12/1973 | Watson | 271/3.1 |
| 4,046,370 | 9/1977 | Navi | 271/3.1 |
| 4,116,428 | 9/1978 | Schubert . | |
| 4,418,907 | 12/1983 | Shultz | 271/157 |
| 4,662,624 | 5/1987 | Focke | 271/157 |
| 4,907,941 | 3/1990 | Focke | 271/157 X |

FOREIGN PATENT DOCUMENTS

| | | |
|---|---|---|
| 1947095 | 3/1970 | Fed. Rep. of Germany . |
| 2423885 | 2/1975 | Fed. Rep. of Germany . |
| 2132174 | 7/1984 | United Kingdom . |

*Primary Examiner*—Richard A. Schacher
*Attorney, Agent, or Firm*—Chilton, Alix & Van Kirk

[57] ABSTRACT

Apparatus for the automatic filling of magazines which receive a stack of package forming blanks, the magazine having an essentially vertical shaft and the blanks being extracted from the lower end of the shaft, the apparatus having a conveyor which may be energized in response to the sensing of the top of a stack of blanks located in the magazine. The conveyor, when energized, delivers a further stack into an extension of the magazine where the further stack is temporarily supported on movable support plates before being released to fall onto the stack already in the magazine.

28 Claims, 1 Drawing Sheet

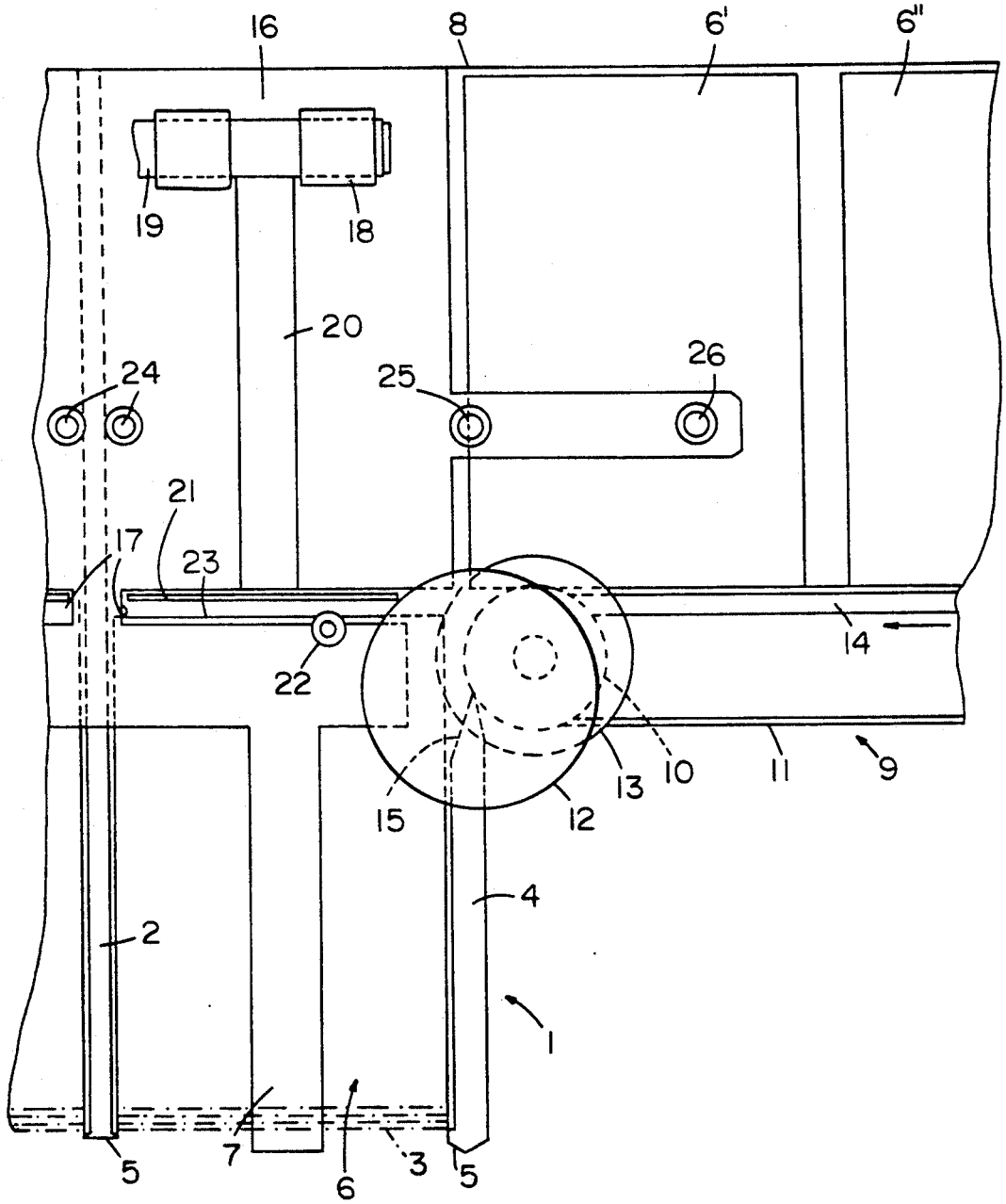
16
8
6'
6"
19
18
20
24
25
26
21
17
23
22
14
10
11
9
13
15
12
4
2
1
5
7
6
3
5

APPARATUS FOR THE AUTOMATIC FILLING OF A MAGAZINE

BACKGROUND OF THE INVENTION (1) Field of the Invention

The present invention relates to the formation of packages and particularly to the supply of blanks, comprised of cardboard or the like for example, to apparatus which fold such blanks into packages. More specifically, this invention is directed to apparatus for the automatic filling of a magazine which receives a stack of cardboard blanks, the blanks being individually extracted from the bottom of the magazine for use in packaging machine, and especially to apparatus for ensuring the continuous supply of package blanks to a cigarette packaging line. Accordingly, the general objects of the present invention are to provide novel and improved methods and apparatus of such character.

(2) Description of the Prior Art

It is well known in the packaging industry to supply, from vertically oriented magazines, cardboard blanks which are folded around articles to be packaged. The cardboard blanks are customarily loaded, in the form of a stack of blanks of predetermined size, into the magazine and are subsequently individually extracted from the bottom of the magazine for use. The filling of the magazines has previously typically been performed manually by extracting a stack of cardboard blanks from a corresponding stock and inserting the stack into the magazine. Since the packaging speeds may be very high, particularly in the cigarette industry, and because there is a practical limit to the vertical size of a magazine, very frequent refilling of the magazines has been necessary in the prior art. The need for frequent refilling imposes a considerable workload on the attendant who, typically, also has other duties to perform with respect to the packaging operation. Accordingly, magazines from which package blanks are extracted often become empty with the result that the entire packaging line comes to a standstill.

German Patent No. 2,423,885 discloses a prior art attempt to solve the above-discussed problem by accomplishing the automatic filling of a magazine with blanks. In the apparatus of this patent, respective stacks of cardboard blanks are guided horizontally and vertically by means of corresponding members which require complicated and mutually coordinated actuating mechanisms. The apparatus of German Patent 2,423,885 is, due to its complexity, relatively expensive and, among other disadvantages, occupies a large amount of space.

SUMMARY OF THE INVENTION

The present invention overcomes the above briefly discussed and other deficiencies and disadvantages of the prior art and, in so doing, provides reliable and uncomplicated apparatus for the automatic filling of a package blank supply magazine. Apparatus in accordance with the present invention employs a substantially vertically oriented magazine shaft, from which the package blanks can be extracted at the bottom end, and a conveyor for transporting stacks of blanks to an upper, delivery zone of an extension of the magazine. The conveyor has a drive which can be activated by means of a sensor responsive to the top of a stack of blanks located in the magazine, the drive being deactivated after a subsequent stack of blanks has been positioned in the delivery zone of the magazine where it is generally in horizontal alignment with the stack from which blanks are being extracted by the packaging apparatus. The apparatus includes supports which are movable into and out of the base of the delivery zone to thereby provide temporary floor onto which the incoming stack may be fed. When the delivery onto these supports is completed, the thus defined floor is removed with minimal vertical drop of the newly delivered stack.

In accordance with a preferred embodiment of the invention, an open-ended magazine shaft is defined, on the side adjacent to the delivery or feed end of the conveyor, by a guide wall. The magazine shaft is further defined, on the side disposed oppositely with respect to the guide wall, by a second wall which projects upwardly above the level of the conveyor by an amount which is at least equal to the height of the incoming stacks of blanks. A sensor which causes conveyor activation is, in the preferred embodiment, positioned at a level which is somewhat below the level of the conveyor, i.e., the sensor is located downwardly with respect to the bottom of an incoming stack of package blanks. The movable supports, which effectively define a discontinuous floor onto which the conveyor deposits an incoming stack of blanks, are pivotal in a direction which is generally transverse to the direction of motion of the incoming stack.

Apparatus in accordance with the invention enables the stock of cardboard blanks for the magazine to be maximized and automatically introduces the blanks, stack by stack, into the magazine. Accordingly, upon implementation of the present invention, a packaging line attendant is required to pay much less attention to the filling level of the magazine and the available stock of blanks and thus has more time available to devote to other tasks. Importantly, and in contradistinction to the prior art, apparatus in accordance with the present invention is of uncomplicated construction and can be retrofitted to existing magazines. This is particularly true in the case of cigarette packaging machines where the present invention has particular applicability and usefulness

BRIEF DESCRIPTION OF THE DRAWING

The present invention may be better understood and its numerous objects and advantages will become apparent to those skilled in the art by reference to the accompanying drawing which schematically illustrates, by means of a side elevation view, apparatus in accordance with a first embodiment of the invention.

DESCRIPTION OF THE DISCLOSED EMBODIMENT

With reference now to the drawing, a magazine for receiving a stack of cardboard blanks 3, which blanks are to be subsequently delivered to a packaging machine, is indicated generally at 1. The drawing actually depicts a portion of a double magazine which has a vertical middle or dividing wall 2 and vertical lateral guides 4, only one of which is shown. The guides 4 are positioned at a distance from middle wall 2 corresponding to the width of the cardboard blanks 3. The middle wall and the lateral guides 4 are provided, at the lower extraction end of magazine 1, with inwardly converging rest or stop edges 5 which will support a stack of the cardboard blanks 3, a stack of blanks previously delivered to the magazine being indicated generally at 6. The magazine is further defined by front vertically extending fingers or guides 7 which are located intermediate the planes defined by middle wall 2 and lateral guides 4. The magazine is further defined by a rear wall 8 which may be formed by the frame of the packaging machine with which the magazine is employed. The walls 2 and 8, guides 4 and fingers 7 thus form an open-ended shaft which receives the stack 6 of cardboard blanks 3, the blanks 3 being extracted at the bottom of the shaft in serial fashion, the blanks moving down the shaft solely under the influence of gravity.

A horizontal belt-type conveyor, indicated generally at 9, is positioned adjacent to magazine 1 and on each side thereof. Each conveyor 9 includes a belt 11 which is guided about rollers 10, only one of which is shown. One of the rollers 10 is driven by means of a motor 12 through a suitable drive or coupling 13. The belt 11, at its upper level, runs over a support plate 14. The lateral guide 4 is sized and shaped so that it terminates at its upper end in a tangential relationship to the belt 11 as it passes about the roller 10. Accordingly, a stack of package blanks transported by the conveyor 9 will, when delivered generally into registration with the magazine shaft, be capable of slipping along the belt 11 and the bevelled upper portion 15 of the guide 4 into the shaft of the magazine 1.

The rear wall 8 of magazine 1 extends over the length of the belt conveyor 9 and projects upwardly above the conveyor a distance which at least corresponds to the intended maximum height of the stacks of package blanks which are to be delivered to the magazine. In the drawing, stacks of package blanks being delivered to the magazine via the conveyor 9 are represented at 6' and 6'', the stacks serving as a stock for the packaging machine which can be positioned next to one another on the upper strand of belt 11 by an attendant. The stacks 6', 6'', when placed on belt 11, will be aligned appropriately relative to the shaft of the magazine 1 by being pressed against the wall 8.

At its front end, as the magazine is depicted in the drawing, a wall 16 extends approximately from the level of the lower strand of belt 11 to the height of the top of the rear wall 8, wall 16 also extending the width of the magazine. Wall 16 cooperates with middle wall 2, which also extends upwardly to the level of maximum expected stock height, and rear wall 8 to form an open sided shaft extension which faces conveyor 9. This open sided magazine shaft extension is, of course, sized so that it may receive the incoming stacks of package blanks.

The oppositely disposed walls 8 and 16 which in-part define the open sided shaft extension which is located above the conveyor belt 11 are, as noted, separated by a distance which corresponds to the width of the incoming stacks 6',6''. Walls 8 and 16 are provided with aligned horizontal slots 17. Bearing brushes 18 are mounted on each of walls 8 and 16 as shown in the case of wall 16. The bearing brushes 18 receive and support rotatable axles 19. Lever arms 20 extend from the axles 19 transversely to the axes thereof. Support plates 21 are affixed to the free ends of the lever arms 20, the length of the arms 20 being selected such that the support plates 20 may pass through the slots 17 so as to project into the interior of the shafts of magazine 1. Each pair of cooperating support plates 21 may, for example, occupy approximately one-third of the space between the walls 8 and 16. Rotation of the axles 19 by means of a suitable drive, not shown, will cause the support plates 21 to be pivoted into and out of the magazine shaft. When the support plates are in the pivoted-in state, they form a support or temporary floor for an incoming stack 6' of cardboard blanks 3, this temporary floor being located at the height of the upper strand of the conveyor belt 11. Accordingly, an incoming stack of cardboard blanks will be transported via the conveyor belt onto the temporary floor defined by the support plates 21. When the support plates 21 are retracted, i.e., pivoted out of registration with the magazine shaft, a stack of blanks supported thereon will drop, under the influence of gravity, and will be brought into the proper lateral position by the dimensions and shape of the shaft and particularly the beveled portion 15 of guide 4. The release of a stack of blanks by pivoting the support plates 21 outwardly will be controlled, in the manner to be described below, such that the vertical drop of the entire stack is minimal.

A first optical sensor 22 is arranged such that it monitors a horizontal region slightly below the level of the upper strand of conveyor belt 11. The purpose of sensor 22 is to detect the top edge 23 of the stack of blanks 6 located in the magazine shaft. When the output of sensor 22 indicates that a sufficient number of blanks have been extracted from the bottom of the stack 6 such that its top edge is below the level of the sensor, the motor 12 will be energized. The energization of motor 12 will result in the stacks 6', 6'' supported on the conveyor 9 being transported in the direction of the middle wall 2 of the magazine 1. The conveyor will continue to operate in this delivery direction until the stack 6' contacts middle wall 2, the stack 6' being supported by plates 21 at this time.

Once energized, the motor 12 may be operated under the control of a timer. In the disclosed embodiment, however, a second optical sensor 24 is provided for the purpose of detecting when an incoming stack of blanks has reached the middle wall 2. Thus, an output signal from a second optical sensor 24 may be employed to deenergize motor 12.

It is to be noted that there may be differing spacing between the stacks 6', 6'' on conveyor 9 because the stacks of blanks are placed on the conveyor manually. Accordingly, it has been found desirable to operate the motor 12 in the delivery direction for a sufficient time to ensure that the stack of blanks 6'' has move into the delivery position previously occupied by stack 6'. This mode of operation may result in the stack 6'' being transported into an abutting relationship with the stack 6' which is in the open-sided extension of the magazine shaft. Accordingly, the present invention may be operated such that, after the stack 6' has been transported into contact with wall 2, the motor 12 will be reversed to thereby cause the conveyor to move the next stack 6' back into a predetermined initial delivery position. The reversal of motor 12 will not affect the stack 6' since it is no longer on the conveyor but, rather, will be supported on the plates 21 when the conveyor is reversed.

A third optical sensor 25 may be provided for the purpose of providing a control signal indicating that the stack 6'' has in fact reached the specific initial delivery position. If sensor 25 is present, it will be activated after sensor 24 has indicated that the stack 6' has reached the middle wall 2. Sensor 25 will then assume control over motor 12 and will stop the motor only when the next stack 6'' has reached the field of view of sensor 25.

In a typical use environment, a cigarette packaging line for example, the extraction of the cardboard blanks 3 from the bottom of magazine 1 occurs at a very high speed, i.e., several hundred blanks per minute. The above-described apparatus and technique, which employs sensor 22 to detect the top edge 23 of stack 6, ensures that the vertical drop of the entire incoming stack 6' will be kept to a minimum since the support plates 22 can be retracted immediately upon deenergization of motor 12.

It is also possible to provide, in the region in which the leading incoming stack of blanks 6' is normally located when in the standby position, a further optical sensor 26. Sensor 26, if present, will be enabled when the conveyor is not operating and will sense the absence of a stack of blanks and cause an acoustic and/or optical warning signal to be generated to alert the attendant that the conveyor 9 needs to be reloaded.

The employment of the discontinuous or partial side wall of the magazine 1, formed by fingers 7, permits the manual filling of the magazine in such a manner that the tilting or jamming of the individual blanks 3 may be avoided. The spaces to either side of the fingers 7 also facilitates the clearing of any jams which may occur during operation.

It should be noted that the present invention is applicable to various types of conveyor mechanisms. By way of example, rather than employing a belt type conveyor, it is possible to utilize a sliding conveyor having, for example, a row of slide walls which respectively engage stacks 6', 6'' which are introduced between such slide walls. If a sliding conveyor is employed, the sensor 25 is not required.

As an alternate to the use of support plates 21 carried by lever arms 20, it is possible to use carrier strips for the stacks of incoming blanks. In such case, the carrier strips must be smaller than the distance between the underside of the incoming stack and the top edge 23 of the previously delivered stack when the newly delivered stack is released by swinging the carrier strip out of the magazine shaft. The carrier strips, if employed, will be capable of swinging into and out of the magazine shaft and thus will be fully equivalent to the support plates 21.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for the automatic supply of package forming blanks to a magazine, the magazine having an open-ended generally vertically oriented shaft, the blanks being individually extracted from the bottom of the magazine shaft, the apparatus further having a conveyor which defines a stack delivery level, the conveyor terminating with its delivery end juxtapositioned to the upper end of the magazine shaft, the conveyor receiving and transporting a series of stacks of the blanks to the magazine and having a drive which may be selectively energized, the improvement comprising:

a guide wall forming the side of the magazine shaft located adjacent to the delivery end of the conveyor;

a second magazine shaft defining wall located opposite to said guide wall, said second wall projecting upwardly above the transport level of the conveyor by an amount at least equal to the maximum height of the stacks of the blanks to be delivered to the magazine whereby said second wall in part defines a magazine shaft extension and a stop for conveyor delivered stacks;

first sensor means positioned to detect the presence of a top edge of a stack of blanks located in the magazine shaft, said first sensor means being located at a level adjacent to but below the conveyor delivery level; and movable supports for selectively engaging oppositely disposed edge regions of the lowermost blank of a stack of blanks delivered into registration with the magazine shaft by the conveyor, said supports being pivotal between a first position wherein they are in registration with the magazine shaft and are oriented generally transversely with respect to the direction of movement of incoming stacks of blansk on the conveyor and a second position wherein they are out of registration with the magazine shaft.

2. The apparatus of claim 1 wherein the conveyor is a belt conveyor, the the belt of the conveyor being supported by a plate in the region where it transports the stacks of blanks.

3. The apparatus of claim 1 further comprising a third magazine defining wall, said third wall being located generally transversely with respect to said guide and second walls and projecting upwardly above the transport level of the conveyor by an amount at least equal to the maximum height of the stacks of the blanks to be delivered to the magazine whereby said second wall in part defines a back wall of the magazine shaft extension.

4. The apparatus of claim 3 further comprising a forth magazine defining wall, said forth wall being oriented generally parallelly with respect to and spaced from said third wall and extending both upwardly above and downwardly from the delivery level of the conveyor, said forth wall in part defining the front wall of the magazine shaft extension, said forth wall extending downwardly from the conveyor delivery level a distance which at least equals of blanks onto a stack of blanks already located in the magazine shaft.

5. The apparatus of claim 4 wherein said third wall and said forth wall are each provided with an opening for the passage of a respective one of said supports.

6. The apparatus of claim 1 wherein said first sensor means causes the conveyor drive to be energized and operate in the conveying direction under the control of a timer.

7. The apparatus of claim 1 wherein said first sensor means causes the conveyor drive to be energized and operate in the conveying direction and wherein said apparatus further comprises second sensor means, said second sensor means being positioned adjacent to said second wall for sensing the presence of a stack of blanks supported on said supports in registration with the magazine shaft extension, said second sensor means causing deenergization of the conveyor drive.

8. The apparatus of claim 1 further including means for detecting the presence of a stack of blanks on the conveyor in the region where it transports the stacks of blanks, said detecting means providing a signal commensurate with the need for replenishing the supply of blanks for the magazine.

9. The apparatus of claim 1 wherein said first sensor means generates an energizing control signal and wherein said apparatus further comprising control means responsive to said control signal for energizing the conveyor drive to cause the conveyor to transport stacks of blanks in the conveying direction until a possible distance between two successive stacks is virtually eliminated and thereafter causing the conveyor to be operated in the opposite direction until a predetermined position is reached by the stack located immediately upstream in the conveying direction of a stack which has been delivered onto said supports.

10. The apparatus of claim 1 wherein said first sensor means causes the conveyor drive to be energized and operate the conveyor in the conveying direction and wherein said apparatus further comprises detector means located adjacent the delivery end of the conveyor, said detector means causing the conveyor drive to remain energized subsequent to the delivery of a stack of blanks onto said supports until the presence of a further stack is sensed by said detector means.

11. The apparatus of claim 5 wherein said first sensor means causes the conveyor drive to be energized and operate in the conveying direction under the control of a timer.

12. The apparatus of claim 5 wherein said first sensor means causes the conveyor drive to be energized and operate in the conveying direction and wherein said apparatus further comprises second sensor means, said second sensor means being positioned adjacent to said second wall for sensing the presence of a stack of blanks supported on said supports in registration with the magazine shaft extension, said second sensor means causing deenergization of the conveyor drive.

13. The apparatus of claim 5 further including means for detecting the presence of a stack of blanks on the conveyor in the region where it transports the stacks of blanks, said detecting means providing a signal commensurate with the need for replenishing the supply of blanks for the magazine.

14. The apparatus of claim 5 wherein said first sensor means causes the conveyor drive to be energized and operate the conveyor in the conveying direction and wherein said apparatus further comprise detector means located adjacent the delivery end of the conveyor, said detector means causing the conveyor drive to remain energized subsequent to the delivery of a stack of blanks onto said supports until the presence of a further stack is sensed by said detector means.

15. The apparatus of claim 11 further including means for detecting the presence of a stack of blanks on the conveyor in the region where it transports the stacks of blanks, said detecting means providing a signal commensurate with the need for replenishing the supply of blanks for the magazine.

16. The apparatus of claim 12 wherein said apparatus further comprises detector means located adjacent the delivery end of the conveyor, said detector means causing the conveyor drive to remain energized subsequent to the delivery of a stack of blanks onto said supports until the presence of a further stack is sensed by said detector means.

17. The apparatus of claim 13 wherein said apparatus further comprises detector means located adjacent the delivery end of the conveyor, said detector means causing the conveyor drive to remain energized subsequent to the delivery of a stack of blanks onto said supports until the presence of a further stack is sensed by said detector means.

18. The apparatus of claim 12 further including means for detecting the presence of a stack of blanks on the conveyor in the region where it transports the stacks of blanks, said detecting means providing a signal commensurate with the need for replenishing the supply of blanks for the magazine.

19. The apparatus of claim 1 further comprising means defining a front wall of the magazine, said front wall being oriented gradually transversely with respect to said guide and second walls, said front wall defining an opening whereby blanks disposed in the magazine may be manually manipulated.

20. The apparatus of claim 19 wherein said front wall defining means includes a web-shaped guide finger which, at least in a region extending upwardly from the bottom of the magazine, is spaced from said magazine defining guide and second walls.

21. The apparatus of claim 4 wherein said forth wall includes a web-shaped portion which extends upwardly from the region of the bottom of the magazine shaft, said web-shaped portion defining an opening in the magazine whereby blanks disposed therein may be manually manipulated.

22. The apparatus of claim 20 wherein said front wall is provided with an opening for the passage of one of said supports.

23. The apparatus of claim 22 further comprising means defining a magazine rear wall which is disposed oppositely with respect to said front wall, said rear wall being provided with an opening for the passage of another one of said supports.

24. The apparatus of claim 23 wherein said first sensor means causes the conveyor drive to be energized and operate in the conveying direction under the control of a timer.

25. The apparatus of claim 23 wherein said first sensor means causes the conveyor drive to be energized and operate in the conveying direction and wherein said apparatus further comprises second sensor means, said second sensor means being positioned adjacent to said second wall for sensing the presence of a stack of blanks supported on said supports in registration with the magazine shaft extension, said second sensor means causing deenergization of the conveyor drive.

26. The apparatus of claim 23 further including means for detecting the presence of a stack of blanks on the conveyor in the region where it transports the stacks of blanks, said detecting means providing a signal commensurate with the need for replenishing the supply of blanks for the magazine.

27. The apparatus of claim 23 further comprises control means responsive to said control signal for energizing the conveyor drive to cause the conveyor to transport stacks of blanks in the conveying direction until a possible distance between two successive stacks is virtually eliminated and thereafter causing the conveyor to be operated in the opposite direction until a predetermined position is reached by the stack located immediately upstream in the conveying direction of a stack which has been delivered onto said supports.

28. The apparatus of claim 23 wherein said first sensor means causes the conveyor drive to be energized and operate the conveyor in the conveying direction and wherein said apparatus further comprises detector means located adjacent the delivery end of the conveyor, said detector means causing the conveyor drive to remain energized subsequent to the delivery of a stack of blanks onto said supports until the presence of a further stack is sensed by said detector means.

* * * * *

UNITED STATES PATENT AND TRADEMARK OFFICE

CERTIFICATE OF CORRECTION

PATENT NO. : 5,186,447

DATED : February 16, 1993

INVENTOR(S) : Siegfried Knecht

It is certified that error appears in the above-identified patent and that said Letters Patent is hereby corrected as shown below:

Column 6, line 19, change "blansk" to --blanks--; line 23, delete "the" (first occurrence); line 34, change "forth" to --fourth--; line 35, change "forth" to --fourth--; line 39, change "forth" to --fourth--; line 40, change "forth" to --fourth--; line 42, after "equals" insert -- the maximum permissible height of fall of a newly delivered stack--; line 45, change "forth" to --fourth--.

Column 8, line 7, change "gradually" to --generally--; line 16, change "forth" to --fourth--.

Signed and Sealed this

Twenty-second Day of March, 1994

*Attest:*

Bruce Lehman

BRUCE LEHMAN

*Attesting Officer*

*Commissioner of Patents and Trademarks*